United States Patent [19]

Niemeyer

[11] Patent Number: 4,588,319

[45] Date of Patent: May 13, 1986

[54] MARKING INSTRUMENT

[75] Inventor: Robert H. Niemeyer, Concord, Calif.

[73] Assignee: Nicolet Instrument Corporation, Madison, Wis.

[21] Appl. No.: 664,530

[22] Filed: Oct. 25, 1984

[51] Int. Cl.[4] ..... B43K 5/00

[52] U.S. Cl. ..... 401/205; 401/198; 401/199; 401/206; 401/260

[58] Field of Search ..... 401/132, 134, 133, 205, 401/209, 219, 224, 232, 263, 206, 198, 199, 258, 260

[56] References Cited

U.S. PATENT DOCUMENTS

| | | | |
|---|---|---|---|
| 511,215 | 12/1893 | Rodwell | 401/260 |
| 748,383 | 12/1903 | Langill | 401/260 |
| 1,305,709 | 6/1919 | Garvey | 401/274 |
| 3,355,239 | 11/1967 | Albrecht | 401/148 |
| 3,377,124 | 4/1968 | Matsumoto | 401/198 |
| 3,397,939 | 8/1968 | Berry | 401/198 |
| 3,427,114 | 2/1969 | Dziuk | 401/199 |
| 3,640,631 | 2/1972 | Sotir | 401/206 |
| 3,966,336 | 6/1976 | Lotfallah | 401/209 |
| 4,017,870 | 4/1977 | Hubbard et al. | 346/140 A |
| 4,017,871 | 4/1977 | Hubbard | 346/140 R |
| 4,145,148 | 3/1979 | Fukmoka | 401/209 |
| 4,317,639 | 3/1982 | Kato | 401/209 |
| 4,382,707 | 5/1983 | Anderka | 401/198 |
| 4,496,258 | 1/1985 | Tanaka et al. | 401/198 |

*Primary Examiner*—Richard J. Apley
*Assistant Examiner*—Alfedo Acoff
*Attorney, Agent, or Firm*—Kinney & Lange

[57] ABSTRACT

The flow of ink in a marking pen is metered by an internal flow restriction. The pen is of the type having a housing, including an ink reservoir, and a marking tip which draws ink from the ink reservoir by capillary action. The reservoir is vented to allow air to be drawn into the reservoir by the pressure drop created when ink is drawn out of the reservoir to the marking tip. A foam flow restrictor is positioned in the housing between the air vent and the ink reservoir to create a desired air flow rate into the reservoir and, in turn, a desired capillary action flow rate of the ink from the reservoir to the marking tip.

17 Claims, 7 Drawing Figures

MARKING INSTRUMENT

BACKGROUND OF THE INVENTION

1. Field of the Invention

The present invention relates to marking instruments, and specifically to a scheme for metering capillary flow of marking fluid in a marking instrument.

2. Description of the Prior Art

Two problems common to many prior art ink pens or marking instruments are the undesired discharge of ink prior to use (i.e., shelf leakage) and the uncontrolled or uneven release of ink during use.

Various schemes have been proposed to prevent undesired or premature ink leakage. For example disposable and sealed ink cartridges have been used. Such ink containers are pierced or tapped for use. Koh-I-Noor Rapidograph, Inc. of Bloomsbury, N.J. has manufactured a completely disposable two-section pen. One section of the pen contains ink in a free-flowing state. The second section of the pen, which is movable with respect to the first section, contains the pen marking tip. A cap or seal is positioned between the two pen sections and by moving the second section toward the first section, the cap or seal is dislodged to permit the ink to flow to the marking tip.

The rate of flow of ink from a pen is a function of the viscosity of the ink along with other variables, such as temperature, pen tip size, etc. To avoid creating a vacuum (and thus stopping ink flow) as ink is drawn out of a pen's ink reservoir, ink reservoirs are usually vented to ambient air to permit air to be drawn into and occupy the space vacated by the ink. General examples of marking instruments constructed in this fashion are shown in the following U.S. Patents:

| U.S. Pat. No. | Inventor | Issued |
|---|---|---|
| 3,355,239 | Albrecht | 11/28/67 |
| 3,377,124 | Matsumoto | 4/9/68 |
| 3,397,939 | Berry | 8/20/68 |
| 3,966,336 | Lotfallah | 6/29/76 |
| 4,017,870 | Hubbard et al. | 4/12/77 |
| 4,017,871 | Hubbard | 4/12/77 |
| 4,145,148 | Fukuoka | 3/20/79 |
| 4,317,639 | Kato | 3/2/82 |
| 4,382,707 | Anderka | 5/10/83 |

These U.S. patents are hereby incorporated by reference.

Various schemes for ink flow regulation are shown in the incorporated patents. For example, the Anderka patent shows a felt tip pen with cylindrical inner and outer pressure equalization chambers. The Hubbard et al. patent shows a pen having an ink reservoir wherein pressure regulation and ink feed is obtained by manipulation of a thin disk. The Berry patent discloses a pen wherein a metering valve is provided between a reservoir of liquid ink and the pen tip for measuring and controlling the flow of liquid ink to the tip. The metering valve in Berry is a cap with an aperture and shape designed to create an air pressure differential within the pen.

As noted above, air vents are often employed as a means to control the flow rate of ink. The major problem with using an air vent to control ink flow is that different inks have different viscosities, and thus different sizes of vents are necessary (all other variables being the same) to obtain identical flow rates for each different ink. In addition, such pens are often used on precision instruments such as plotters. The air vents of such pens must thus be very precise themselves in order to achieve the desired ink flow rate. To obtain a precise ink flow rate dependent upon the size of an air vent requires careful machining and expensive manufacturing costs in making the pen and air vent arrangement.

SUMMARY OF THE INVENTION

The present invention provides a marking instrument in which the flow rate of marking fluid from a marking fluid reservoir to a marking tip is precisely controlled by means of an air permeable medium. The permeable medium is positioned between atmospheric vent means for the reservoir and the reservoir itself. The flow rate control medium restricts the inflow of air into the reservoir which in turn controls the outflow of marking fluid from the reservoir to the marking tip.

In a preferred embodiment, the marking fluid is drawn from the marking fluid reservoir by capillary action and the permeable medium comprises foam. The flow rate of the marking fluid is varied by varying the density of the foam. Releasable sealing means are provided between the marking fluid reservoir and the vent means. The releasable sealing means preferably includes a first portion of the housing which contains the marking fluid reservoir and a second portion of the housing which is slidably connected to the first portion so that the second portion is movable between a sealed extended position and an operable retracted position. A cap secured between the reservoir and the vent means (when the second portion of the housing is in its sealed extended position relative to the first portion of the housing) creates a seal therebetween. When the second portion is moved toward its operable retracted position, the cap is dislodged to break the seal and allow marking fluid to flow from the first portion of the housing toward the second portion of the housing.

In a preferred embodiment, the permeable medium is also placed in a marking fluid flow path between the marking fluid reservoir and the marking tip.

DETAILED DESCRIPTION OF THE PREFERRED EMBODIMENTS

Figure 1:
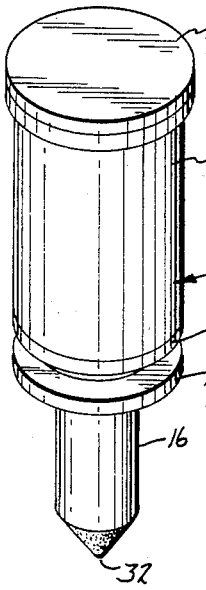
FIG. 1 is a perspective view of a marking instrument of the present invention.

In FIG. 1, a marking pen 10 of the present invention is shown. The pen 10 is designed for use in a precision plotting instrument and is disposable after use. The pen 10 has a housing 12 which includes an upper housing portion 14 and a lower housing portion 16.

Figure 2:
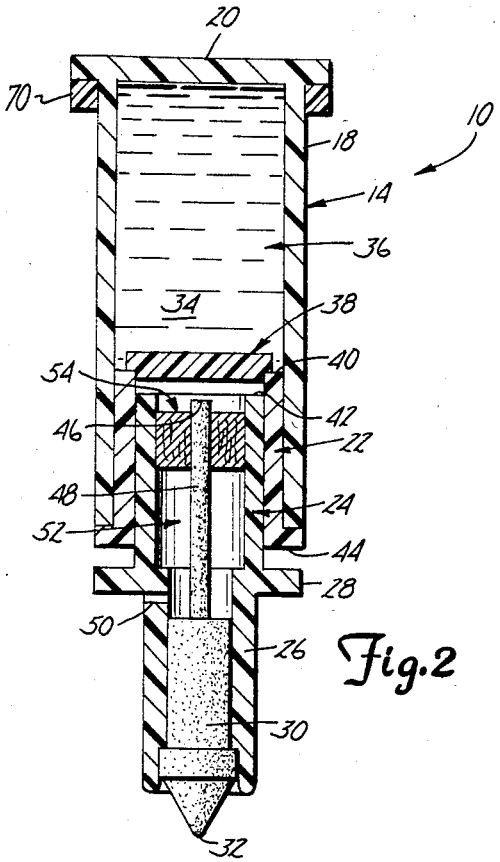
FIG. 2 is a sectional view of a preferred embodiment of the marking instrument of the present invention in position for transport and storage.

As shown in FIG. 2, the upper housing portion 14 has a cylindrical sidewall section 18 with a top wall 20 secured at a first end thereof. A reservoir seal 22 is mounted to the upper portion 14 adjacent a second end of the cylindrical wall section 18. An interior surface of the reservoir seal 22 is preferably cylindrical and is sized to sealably and slidably mate with an outer cylindrical surface of a first upper section 24 of the lower housing portion 16. The lower housing portion 16 has a second lower section 26 with a shoulder 28 extending annularly outwardly between the first section 24 and the second section 26. A marking tip 30 of the pen 10 is mounted within the lower housing portion 16 so that a writing point 32 thereof extends outwardly from the second lower section 26, as seen in FIG. 2. The marking tip 30 can be of any suitable construction, such as a fiberous (felt-type) structure or ball-point type device.

FIG. 2 shows the marking pen 10 of the present invention in configuration for transport and storage prior to actual usage. Marking fluid 34 is retained within a marking fluid reservoir 36 defined primarily by the interior of the upper housing portion 14 of the housing 12. The marking fluid 34 is prevented from flowing to the marking tip 30 by a cap 38 which is removably mounted within the upper housing portion 14 on an inner end 40 of the reservoir seal 22. The cap 38 and inner end 40 mate in a friction fit to sealably contain the marking fluid 34 in a free-flowing state in the reservoir 36. The reservoir seal 22, in combination with the cap 38, prevents leakage or flow of the marking fluid 34 out of the reservoir 36.

Figure 3:
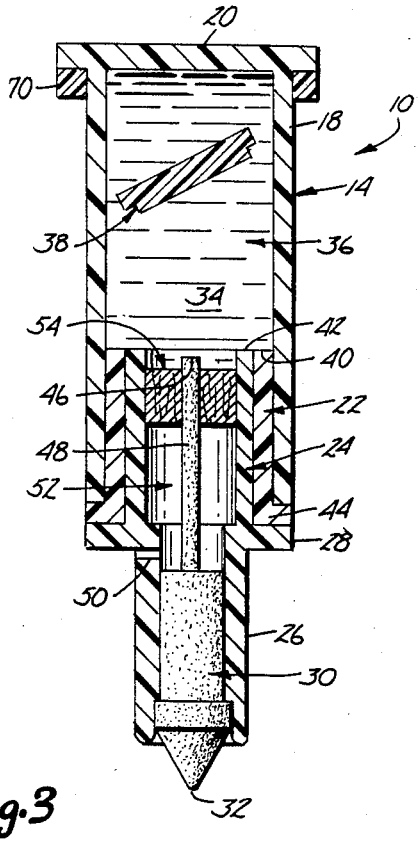
FIG. 3 is a sectional view of the marking instrument of FIG. 2 in position for use.

The first section 24 of the lower housing portion 16 is slidably received within the reservoir seal 22 so that the lower housing portion 16 is movable between a sealed extended position (as in FIG. 2) and an operable retracted position (as in FIG. 3). As shown in FIG. 2, the components are assembled to leave a clearance between the cap 38 and an inner end 42 of the first section 24 of the lower housing portion 16. A larger clearance is provided between an outer end 44 of the reservoir seal 22 and the shoulder 28 of the lower housing portion 16. To dislodge the cap 38 and thereby break the seal between the reservoir 36 and the marking tip 30, the lower housing portion 16 of the marking pen 10 is moved toward the upper housing portion 14 thereof until the shoulder 28 abuts the outer end 44 of the reservoir seal 22. Before the shoulder 28 bottoms out against the reservoir seal 22, the inner end 42 of the first upper section 24 engages the cap 38 and pushes it off of its sealed position on the inner end 40 of the reservoir seal 22. Once the cap 38 is dislodged, as shown in FIG. 3, marking fluid 34 can then flow to an inlet end 46 of an upper stem 48 of the marking tip 30, to be drawn into and through the marking tip 30 to the writing point 32.

Preferably, the marking fluid 34 is drawn through the marking tip 30 by capillary action. As marking fluid 34 is withdrawn from the reservoir 36, it must be replaced by another fluid or gas or marking fluid flow from the reservoir 36 will stop. In the marking pen 10 of the present invention, air is vented into the reservoir 36 to take the place of marking fluid 34 as it is used. At least one vent 50 is provided in the second lower section 26 of the lower housing portion 16. Each vent 50 (only one is shown in the Figures) provides communication between the ambient atmosphere and the interior of the lower housing portion 16 which defines an expansion chamber 52. The marking tip 30 extends through the expansion chamber 52 from the writing point to the reservoir 36.

An air permeable medium 54 is secured within the lower housing portion 16 at an end of the expansion chamber 52 adjacent the reservoir 36 to separate the vent 50 and expansion chamber 52 from the marking fluid 34 (once the cap 38 is dislodged). Preferably, the medium 54 is comprised of foam. In the embodiment of the marking pen 10 shown in FIGS. 2 and 3, the foam 54 is generally cylindrical and has the upper stem portion 48 of the marking tip 30 extending centrally therethrough. The foam 54 thus prevents the free-flow of marking fluid 34 out of the marking pen 10 through the vent 50.

In operation, the capillary action of the marking tip 30 draws marking fluid 34 out of the reservoir 36. The removal of marking fluid 34 from the reservoir 36 creates a pressure drop in the reservoir 36 (lower than atmospheric pressure) which then draws air into the pen 10 and toward the reservoir 36 through the vent 50. The foam 54 is positioned in the air flow path from the vent 50 and the reservoir 36 and thus restricts the free flow of air, allowing the air to enter the reservoir 36 only at a predetermined air flow rate. This rate is variable by changing the density of the foam 54. Because the rate of air flow into the reservoir 36 is constrained by the foam 54, the rate of marking fluid 34 flow out of the reservoir 36 to the marking tip 30 is similarly controlled. The foam 54 thus creates a desired capillary action flow rate of marking fluid 34 from the marking fluid reservoir 36 to the writing point 32 of the marking tip 30. Of course, there is no air flow or marking fluid flow (or metering of the flows by the filter) until the cap 38 has been dislodged to break the seal which exits between the reservoir 36 and the vent 50.

Different marking fluids have different viscosities. For example, red ink flows more freely than black ink. For pens containing different marking fluids, different foam densities or permeabilities may be required to obtain identical flow rates of the different marking fluids. For red ink, a more dense foam is required than for black ink in order to obtain the same flow rate for both inks. The capillary action flow rate of the marking fluid, which is a function of the marking fluid viscosity, is thus varied by varying the density or permeability of the foam.

Figure 4:
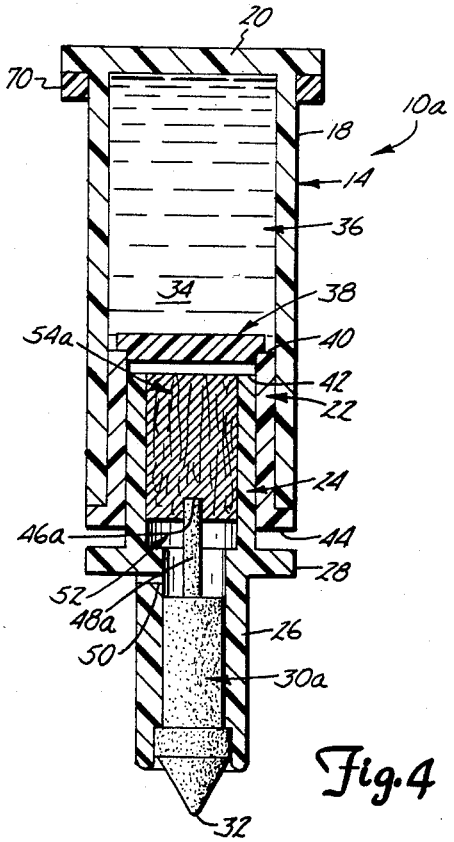
FIG. 4 is a sectional view of a second preferred embodiment of the marking instrument of the present invention in position for transport and storage.
Figure 5:
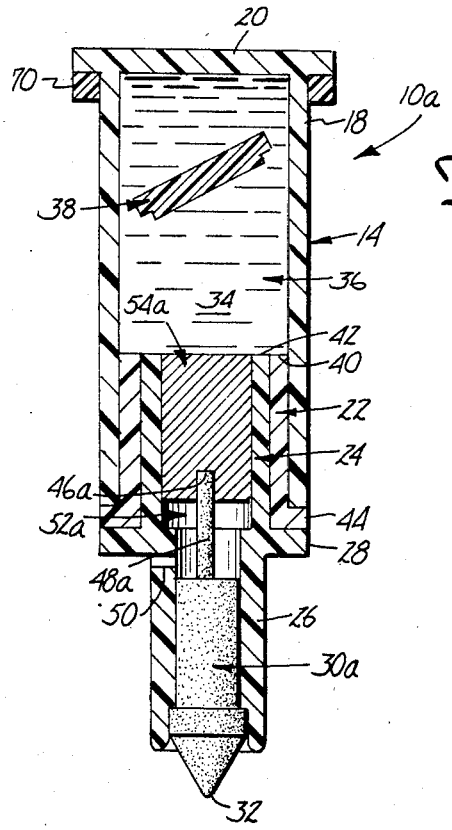
FIG. 5 is a sectional view of the marking instrument of FIG. 4 in position for use.

FIGS. 4 and 5 illustrate a second preferred embodiment of the marking instrument of the present invention. For those components of the marking instrument which are the same as those shown in the embodiment shown in FIGS. 2 and 3, the same reference characters have been used in FIGS. 4 and 5. Those components which are somehow different, but functionally similar, in the second embodiment of the invention, have reference characters which bear the subscript "a".

In the marking pen **10*a* shown in FIGS. 4 and 5, the upper stem portion 48*a* of the marking tip 30*a* does not extend entirely through the foam 54*a*. As shown, the inlet end 46*a* of the upper stem portion 48*a* is embedded within the foam 54*a* and does not directly communicate with the reservoir 36 above the foam 54*a* when the cap 38 is dislodged, as shown in FIG. 5. In the marking pen 10*a* of this second embodiment, the foam 54*a* is positioned in two flow paths: (1) the air flow path between the vent 50 and the reservoir 36; and (2) the marking fluid flow path between the reservoir 36 and the inlet end 46*a* of the upper stem portion 48*a* of the marking tip 30**.

The capillary action created by the marking tip 30*a* draws metering fluid 34 from the reservoir 36, through the foam 54*a* and into the inlet end 46*a* of the upper stem portion 48*a*. At the same time, air flows into the lower housing portion 26 via the vent 50 and through the expansion chamber 52*a* and foam 54*a* into the reservoir 36 to take the place of the marking fluid 34 drawn therefrom. The foam 54*a* thus performs a flow metering function simultaneously for both the air and the marking fluid in the pen 10*a*.

The operation of the marking pen 10*a* of FIGS. 4 and 5 is, except for the difference in the foam 54*a* arrangement discussed above, otherwise the same as the operation of the marking pen 10 shown in FIGS. 1 and 2. FIG. 4 shows the pen 10*a* in position for transport and storage and FIG. 5 shows the pen 10*a* with its lower housing portion 26 moved to its operable retracted position with respect to the upper housing portion 24 to dislodge the cap 38 and permit air and marking fluid flow.

Figure 6:
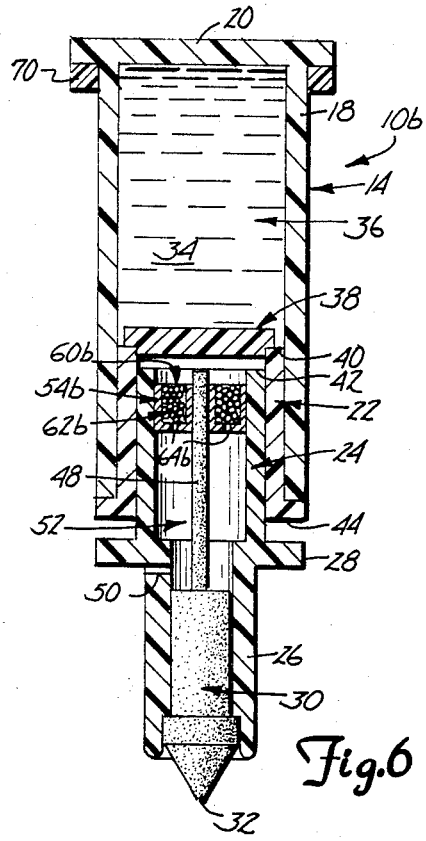
FIG. 6 is a sectional view of a third preferred embodiment of the marking device of the present invention in position for transport and storage.
Figure 7:
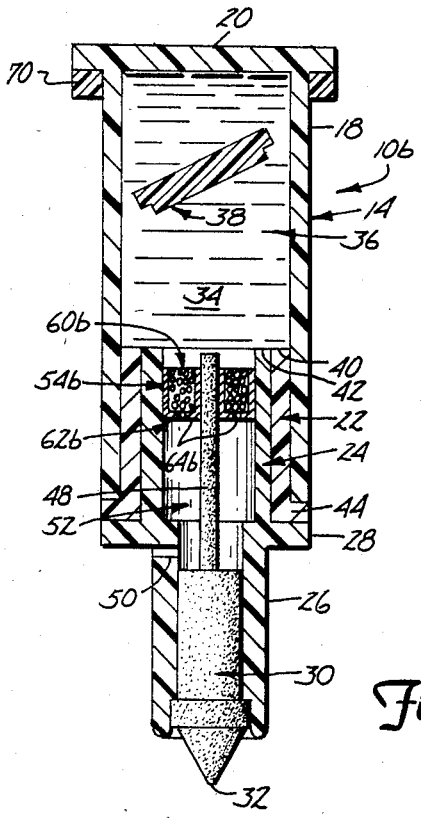
FIG. 7 is a sectional view of the marking instrument of FIG. 6 in position for use.

FIGS. 6 and 7 illustrate a third preferred embodiment of the marking instrument of the present invention. For those components of the marking instrument which are the same as those shown in the embodiment shown in FIGS. 2 and 3, the same reference characters have been used in FIGS. 6 and 7. Those components which are somehow different, but functionally similar, in the third embodiment of the invention, have reference characters which bear the subscript "b".

In the embodiments discussed above and shown in FIGS. 2–5, foam is contemplated as the desired flow restriction medium. Foam is resilient, easily formed or cut and relatively inexpensive. Other flow restriction components, such as a plurality of particles of sintered polyethylene or teflon, glass beads, plastic beads or crystals of some type, etc., also achieve the same or similar flow metering result. Resilient foam is inherently self-seating, when compacted (such as it would be when fitted within the lower housing portion 16), but other components (such as glass beads) are not. In the third embodiment shown in FIGS. 6 and 7, the flow restrictor 54*b* is positioned to provide resistance in the air flow path between the vent 50 and the reservoir 36. The restrictor 54*b* consists of foam or a plurality of particles 60*b*. When particles 60*b* are used to form the restrictor 54*b*, a resilient seal 62*b* is provided which houses the particles 60*b* and engages the inner cylindrical wall of the first upper section 24 of the lower housing portion 26 and the upper stem portion 48 of the marking tip 30 as shown in FIGS. 6 and 7. The seal 62*b* is preferably formed from rubber or some other suitable resilient sealing material and thus provides a tight seal to prevent air or marking fluid from flowing between the vent 50 and reservoir 36 other than through the particles 60*b*. A plurality of apertures 64*b* are provided in the seal 62*b* to permit the flow of air from the expansion chamber 52 through the particles 60*b* and into the reservoir 36.

This third embodiment of FIGS. 6 and 7 has the same flow characteristics as the first embodiment shown in FIGS. 2 and 3. The restrictor 54*b* meters the flow rate of air into the reservoir 36 as marking fluid 36 is drawn out of the reservoir by the marking tip 30. The restrictor 54*b* does not directly restrict or meter the flow rate of the marking fluid 34, but indirectly does so by metering the flow rate of air into the reservoir 36.

In each of the embodiments shown, an expansion chamber is provided to compensate for thermal expansion of the marking fluid 34 in the reservoir 36. Once the cap 38 has been dislodged, if the marking fluid 36 is somehow warmed to cause it to expand to create a volume greater than that of the reservoir (and marking fluid is not drawn from the reservoir at a great enough rate by the capillary action of the marking tip 30), marking fluid would naturally flow through the restrictor 54 and into the expansion chamber 52 and ultimately out of the vent 50. To minimize the potential for such leakage, the expansion chamber 52 volume is made relatively large. Marking fluids or inks of various colors may be used in pens which are otherwise identical in configuration. To indicate the color of the ink contained therein, a color ring 70 is mounted about the upper housing portion 14 of each pen 10.

Although the present invention has been described with reference to preferred embodiments, workers skilled in the art will recognize that changes may be made in form and detail without departing from the spirit and scope of the invention.

What is claimed is:

1. In combination with a marking instrument of the type having a housing with a marking fluid reservoir therein, vent means for venting the reservoir to ambient air and a marking tip which draws marking fluid from the fluid reservoir, the improvement which comprises:

permeable flow rate control means for creating a desired flow rate of marking fluid from the marking fluid reservoir to the marking tip; and sealing support means for supporting the flow rate control means in the housing and preventing passage of marking fluid between the reservoir and vent means other than through the flow rate control means.

2. The invention of claim 1 wherein the housing has vent means therethrough for venting the marking fluid reservoir to ambient air and allowing air to be drawn into the reservoir by a pressure drop created therein when marking fluid is drawn out of the reservoir.

3. The invention of claim 2 wherein the flow rate control means is positioned in an air flow path in the housing between the vent means and the marking fluid reservoir.

4. The invention of claim 3 wherein the flow rate control means is also positioned in a marking fluid flow path in the housing between the marking fluid reservoir and the marking tip.

5. The invention of claim 1 wherein the flow rate control means is foam.

6. The invention of claim 2 further comprising:

releasable sealing means between the marking fluid reservoir and the vent means.

7. The invention of claim 6 wherein the releasable sealing means comprises:

a first portion of the housing which contains the marking fluid reservoir;

a second portion of the housing which is slidably connected to the first portion so that the second portion is movable between a sealed extended position and an operable retracted position; and a cap positioned between the reservoir and the vent means when the second portion is in its sealed extended position relative to the first portion to create a seal therebetween; and means for dislodging the cap to break the seal and allow marking fluid flow from the first portion of the housing toward the second portion of the housing when the second portion is moved toward its operable retracted position.

8. A marking instrument comprising:

housing means having a reservoir therein for containing marking fluid in a free-flowing state;

marking tip means secured with respect to the housing;

means for drawing marking fluid from the reservoir and to the marking tip means;

vent means through the housing for venting the reservoir to atmosphere so that as marking fluid is drawn from the reservoir air is drawn into the reservoir through the vent means;

flow rate control means between the vent means and the reservoir for creating a desired air flow rate into the reservoir and a desired flow rate of the marking fluid from the reservoir to the marking tip; and sealing support means for supporting the flow rate control means in the housing and preventing passage of marking fluid between the reservoir and vent means other than through the flow rate control means.

9. The marking instrument of claim 8 wherein the flow rate control means is foam.

10. The marking instrument of claim 9 wherein the flow rate, which is a function of marking fluid viscosity, is varied by varying the density of the foam.

11. A marking instrument comprising:

housing means having a reservoir therein for containing marking fluid in a free-flowing state;

marking tip means in communication with the marking fluid reservoir;

vent means in the housing for venting the reservoir to ambient air;

means for drawing marking fluid from the reservoir to the marking tip to create a pressure drop in the reservoir;

flow rate control means between the vent means and the reservoir for metering air flow into the reservoir; and sealing support means for supporting the flow rate control means in the housing and preventing passage of marking fluid between the reservoir and vent means other than through the flow rate control means.

12. In combination with a marking instrument of the type having a housing with a marking fluid reservoir therein, a marking tip which draws marking fluid from the fluid reservoir and vent means for venting the reservoir to ambient air and allowing air to be drawn into the reservoir by a pressure drop created therein when marking fluid is drawn out of the reservoir, the improvement which comprises:

permeable flow rate control means for creating a desired flow rate of marking fluid from the marking fluid reservoir to the marking tip; and releasable sealing means between the marking fluid reservoir and the vent means, the releasable sealing means including:

a first portion of the housing which contains the marking fluid reservoir;

a second portion of the housing which is slidably connected to the first portion so that the second portion is movable between a sealed extended position and an operable retracted position;

a cap positioned between the reservoir and the vent means when the second portion is in its sealed extended position relative to the first portion to create a seal therebetween; and means for dislodging the cap to break the seal and allow marking fluid flow from the first portion of the housing toward the second portion of the housing when the second portion is moved toward its operable retracted position.

13. The invention of claim 12 wherein the flow rate control means is positioned in an air flow path in the housing between the vent means and the marking fluid reservoir.

14. The invention of claim 13 wherein the flow rate control means is also positioned in a marking fluid flow path in the housing between the marking fluid reservoir and the marking tip.

15. The invention of claim 12 wherein the flow rate control means is foam.

16. The marking instrument of claim 15 wherein the flow rate, which is a function of marking fluid viscosity, is varied by varying the density of the foam.

17. The marking instrument of claim 5 wherein the flow rate, which is a function of marking fluid viscosity, is varied by varying the density of the foam.

* * * * *